US007121209B2

(12) United States Patent
Vaidyanathan et al.

(10) Patent No.: US 7,121,209 B2
(45) Date of Patent: Oct. 17, 2006

(54) DIGITAL SEMICONDUCTOR BASED PRINTING SYSTEM AND METHOD

(76) Inventors: Nandakumar Vaidyanathan, 16522 Hillview Cir. #A, Huntington Beach, CA (US) 92649; Ravi Subrahmanyan, 7 Balmorra Rd., Windham, NH (US) 03087

( * ) Notice: Subject to any disclaimer, the term of this patent is extended or adjusted under 35 U.S.C. 154(b) by 0 days.

(21) Appl. No.: 10/759,765

(22) Filed: Jan. 16, 2004

(65) Prior Publication Data

US 2005/0155507 A1 Jul. 21, 2005

(51) Int. Cl.
*B41M 1/42* (2006.01)

(52) U.S. Cl. ..... 101/489; 101/401; 347/111; 347/112

(58) Field of Classification Search ..... 101/483–489, 101/401; 347/111, 112, 141, 142
See application file for complete search history.

(56) References Cited

U.S. PATENT DOCUMENTS 3,518,698 A * 6/1970 Kazan et al. ..... 347/112
3,678,852 A * 7/1972 Feinleib et al. ..... 430/302
4,030,107 A * 6/1977 Tagawa ..... 347/143
4,833,990 A * 5/1989 Hirt et al. ..... 101/130
5,109,240 A * 4/1992 Engl et al. ..... 347/111
6,546,868 B1 * 4/2003 Hess ..... 101/453

FOREIGN PATENT DOCUMENTS

CA 2195826 A * 7/1997

* cited by examiner

*Primary Examiner*—Minh Chau
(74) *Attorney, Agent, or Firm*—Thomas P. Grodt

(57) ABSTRACT

The print engine is composed of a semiconductor memory layer overlaid on an insulated conductive layer with a one to one correspondence of each memory cell with the conductive pad on the insulated layer. The entire structure can be fashioned into a either a planar structure or a cylindrical structure with insulated conductive pads providing protection to the sensitive semiconductor memory from impact loading that occurs during the printing process.

42 Claims, 13 Drawing Sheets

FIG. 1a
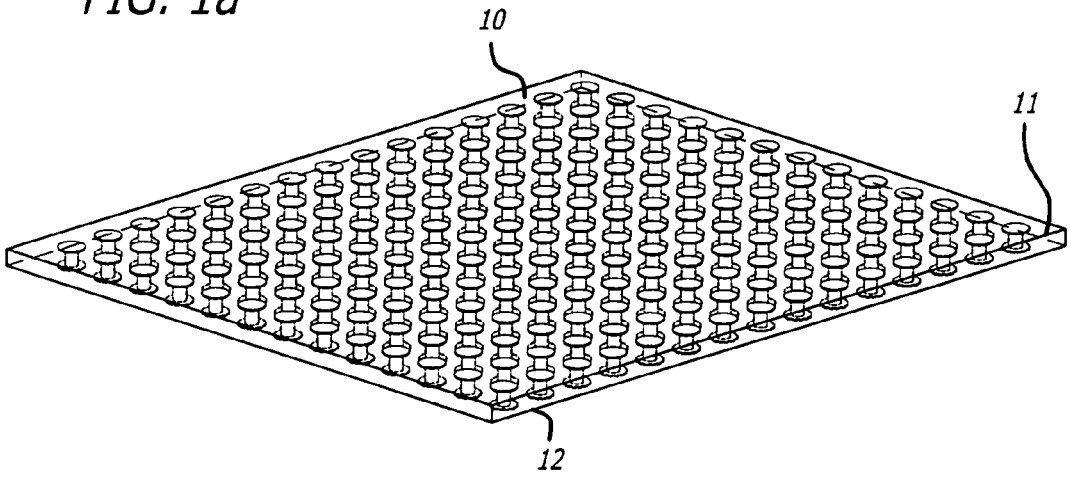
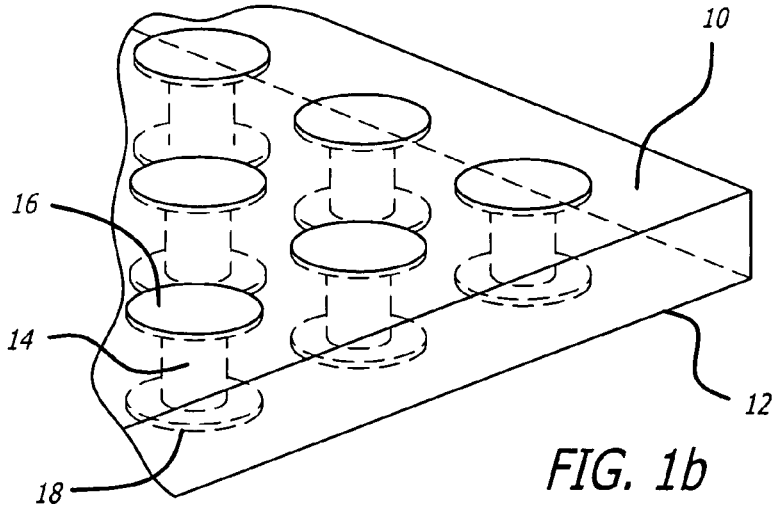
FIG. 1b

FIG. 2a
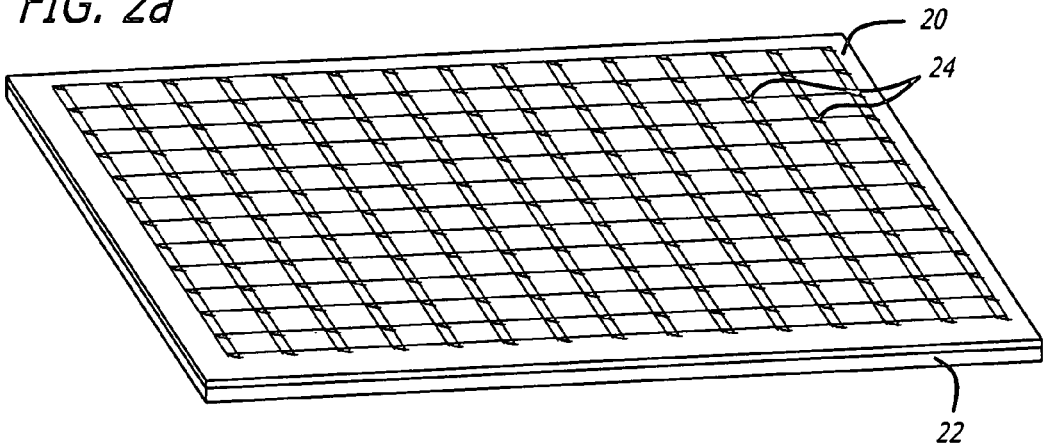
FIG. 2b
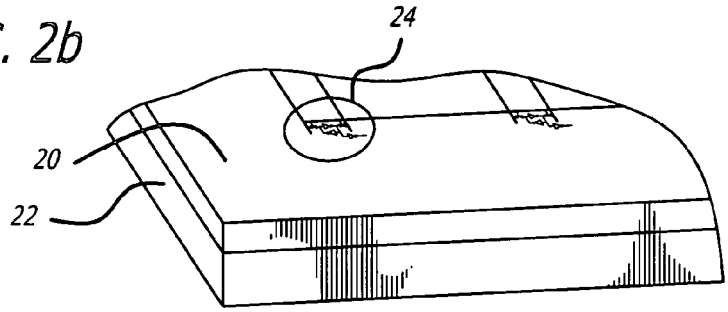
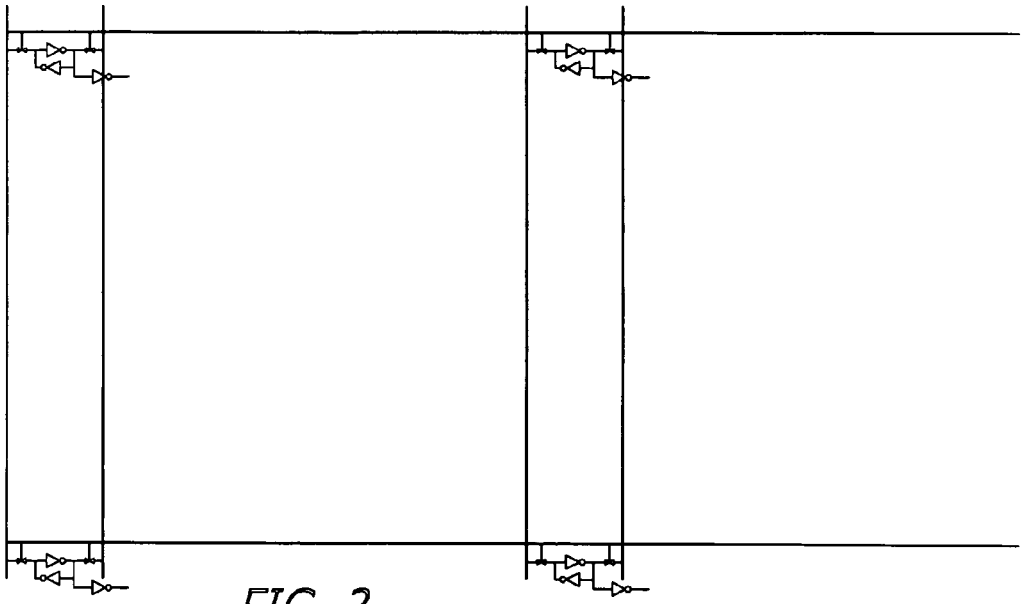
FIG. 3

FIG. 4a
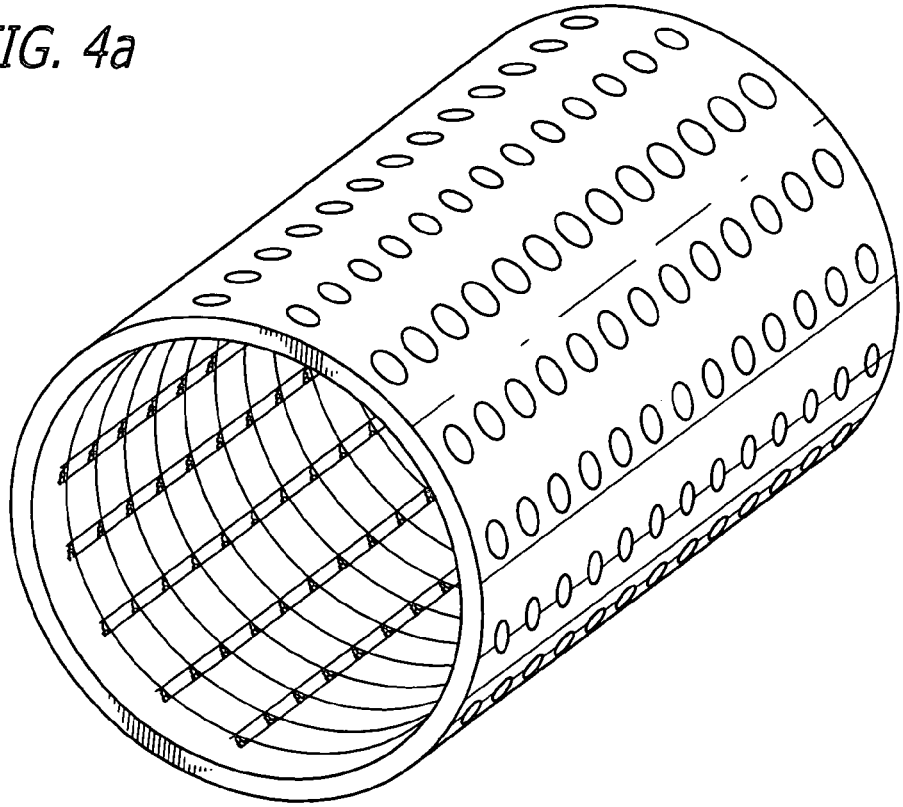
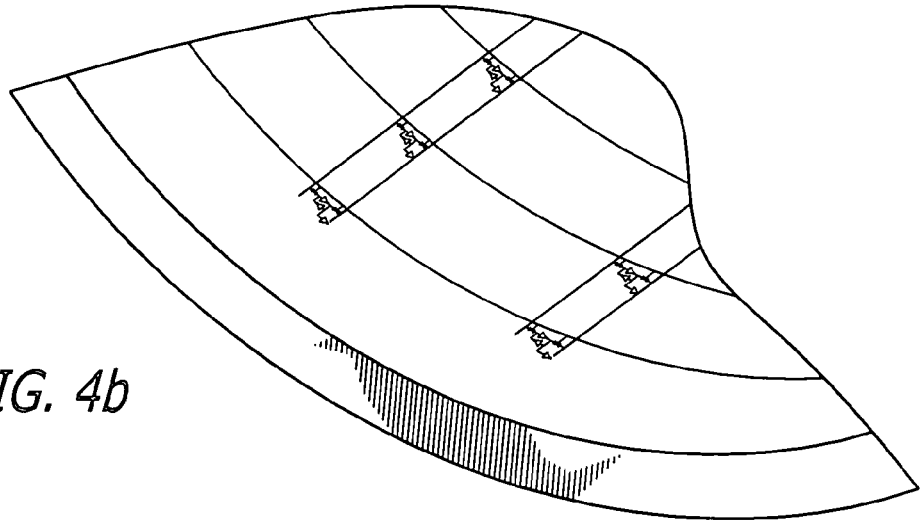
FIG. 4b

FIG. 9a
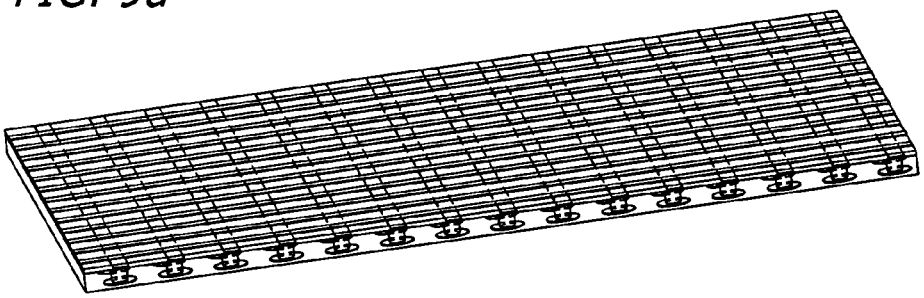
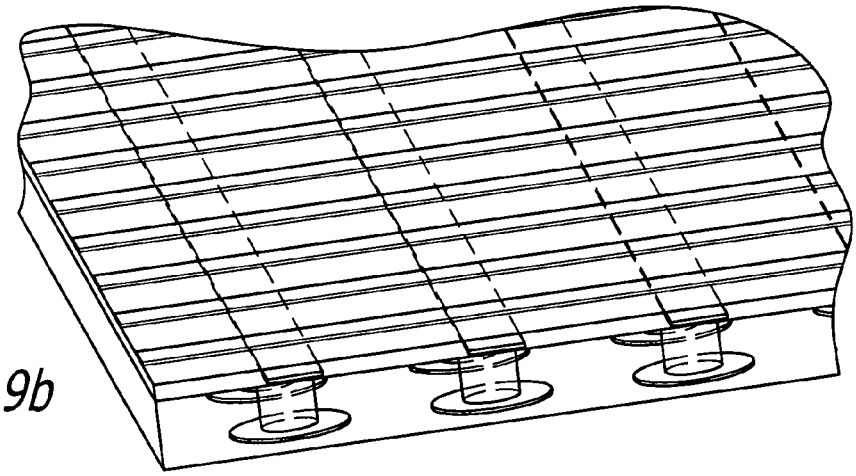
FIG. 9b
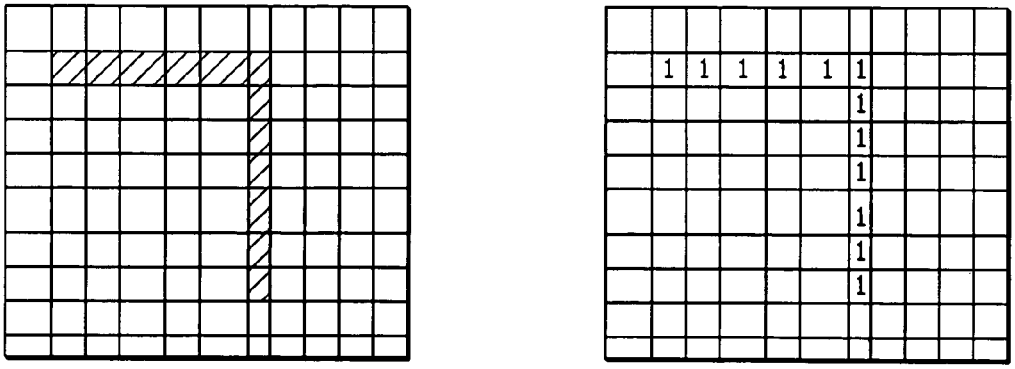
FIG. 10

FIG. 13
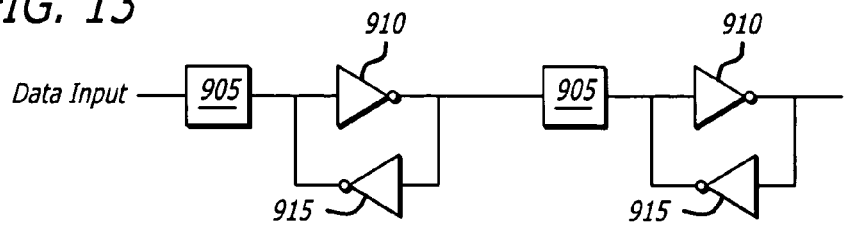
FIG. 14
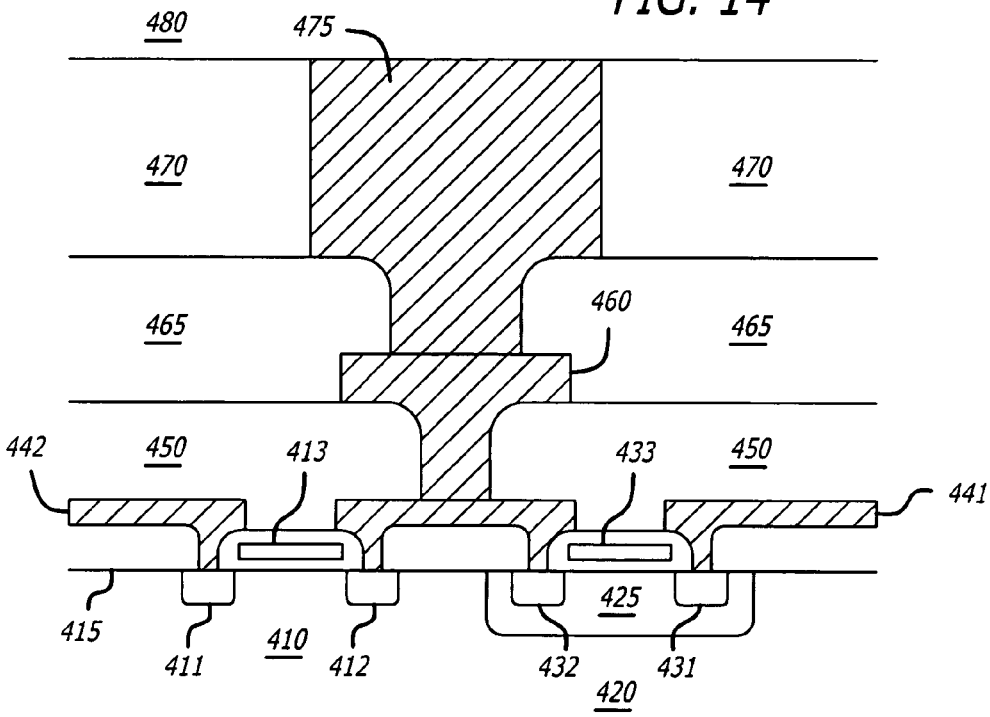
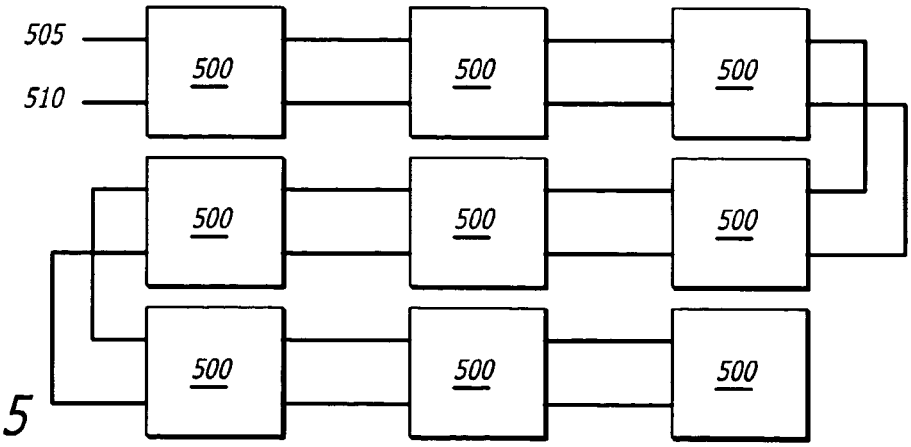
FIG. 15

DIGITAL SEMICONDUCTOR BASED PRINTING SYSTEM AND METHOD

BACKGROUND

1. Field of the Invention

The present invention generally relates to semiconductor techniques for printing. Nandakumar Vaidyanathan 2. General Background and State of the Art There are currently several dominant techniques used in computer based and commercial printing (non-impact printing).

A large portion of Personal Computer (PC) based printing is based on Ink Jet technology, or "Drop on Demand" methods where the image to be printed is constructed on an appropriate printing medium such as paper, plastic, textiles, printing plates and even silicon based substrates using print heads which eject drops of ink at the appropriate location on the printing medium. Since the ejection of ink occurs at the time the image is being printed this is often called "Drop on Demand" printing. The ink ejection mechanism may be controlled using piezo electric mechanisms or thermal mechanisms (ink jet or bubble jet). These printing methods rely on electronics that reside on the computer and on the printing equipment to deposit the ink on the printing medium. Since the entire image is constructed on a drop-by-drop basis, this can be a rather slow process.

Another kind of commercial printing that is carried out using the ink-jetting technique is called the Continuous Ink-Jetting Method. In this method, a continuous jet of ink is squirted through space, and using electrostatic deflector plates, the ink is selectively directed at the appropriate medium through a mesh, leading to deposition of dots to create patterns. The unused ink is directed through another channel and is recycled. This is the basis of the Continuous Ink Jetting technique and this process uses both charged and uncharged inks.

Another popular PC based printing method is "Laser Jet" or "Laser Writing" which is based on electrophotography. This method originated from Xerographic techniques for replication of images. In the original xerographic technique, a charged drum (photoconductive drum) is optically exposed to the image to be duplicated. Based on the image, charges are removed on the photoconductive drum using either a laser beam, or any other light source of appropriate spectral content and energy such as light emitting diodes (LED's). Specially charged ink, called toners, which could be either a fine powder or a liquid, are attracted to the locations on the photoconductive drum, which have the opposite electrical polarity. From the photoconductive drum, these charged particles are then transferred to the printing medium. In this method of printing, the contents of the entire image can be transferred to a photoconductive drum, and then the transfer effected to the printing media in a single step. This method of image transfer is therefore faster than the "Drop on Demand" technique previously described.

Another printing technology used in the commercial printing world, called magnetography, is similar to electrophotography, but uses magnetic fields instead of electrostatic fields to propel charges.

Perhaps the most dominant technology in the commercial printing world is based on lithography. Lithography involves a plate or an intermediate medium, on which the image to be printed is either exposed or engraved using a variety of techniques such as photography, laser ablation, thermal ablation and more recently ink jet based techniques. The areas of the printing plate have areas which accept ink (olephilic—oil loving) and areas, which accept water (hydrophilic). In general, the oil loving areas of the image do not accept water and the water loving areas do not accept ink. As the lithographic printing ink is an emulsion of pigments and water, the ink and water selectively migrate to their respective locations on the printing plates. Once the ink and water have migrated to their respective locations, it is then transferred to the medium being printed or to an intermediate cylinder called an offset cylinder and from the offset cylinder the image is deposited on the final medium.

There are four other processes, namely flexography, gravure, letterpress and screen printing.

The above-mentioned technologies are fairly well established. They have great advantages in their respective niches. However, there are significant disadvantages with each of the methods.

For example, as previously mentioned, ink jet based printers are quite slow. There are high costs associated with electrostatic printing processes for commercial printing, due to low throughput and inability to provide more than a certain number of copies (40,000 copies with current technology) on an electro-photography based machine, before the photoconductor drum is rendered useless for any other more reproduction. In lithographic printing, primary costs include use of expensive printing plates or spools, and high costs for recycling and disposal of environmentally unfriendly chemicals. Furthermore, the imaging or pre-imaging equipment used in the commercial printing world can be quite large and bulky.

Most commercial printing technology also involves disposable pieces. For example, lithographic printing involves using a new printing plate for every image printed. There are also inks that need to be poured and replenished, if one wants to make a large number (many thousands) of copies. With xerography, a new printing plate is not used each time. However, the same large number of copies cannot be made because the charges wear off and need to be replenished. In addition, the photoconductive drums lose sensitivity to spectral content after multiple usage.

Finally, personal printers such as inkjet and laser printers utilize ink cartridges, which need to be replaced on a regular basis. Much of the money made in the personal printing market is by consumables such as ink cartridges, toner, drums, and printing plates.

SUMMARY

It is therefore an object of the printing system described herein to provide a new method of printing whereby there is no intervening consumable medium.

Accordingly, the system described herein provides for a printing system and method comprising an electronic stored image based scheme and a semiconductor memory drum, or a smart cylinder.

In another embodiment, the semiconductor printing system can also be composed of a flat semiconductor memory panel, over which a system of charged and uncharged rollers can translate successively, and selectively transfer charged ink (toner) to and from the semiconductor memory panel to a printing medium.

The electronic stored image permits the digital printing elements to print a digitally stored image onto any medium. This is accomplished by using a semiconductor memory-based scheme in which an image is stored in an electronic memory with each digital printing element occupying one memory location. Since information is stored in memory as a voltage, by directly coupling the memory location to a conductive element, the stored voltage can be used to directly control whether or not conductive toner based inks are attracted to that conductive element.

The printing system provides for a printing drum comprising a semiconductor memory. A semiconductor memory uses decoding elements to allow access to each of many storage locations without requiring an individual connection to each location. The system therefore utilizes the semiconductor memory structure to spatially map a digitally stored bit of data (0 or 1) to a physical location.

As all printed images are composed of dots of ink at a specific location on a medium, it is possible to translate the specific location to where the ink can be transferred to a memory cell in a chip, and from the memory cell to the final printing medium. It is therefore possible to "load" an image efficiently over a bus or communication channel. Once the image is loaded into the memory, the conductive locations associated with each printing element receive the appropriate voltage and the image can be formed on any printing media. After a desired number of images have been printed, a new image can be downloaded and a new image can be printed. This is the basic principle of the print engine.

The system therefore provides for a nearly infinitely reusable read-write type printing mechanism where one cylinder or multiple cylinders can take up any colors and then the image can be transferred directly digitally.

When appropriately used, this system and method would bridge the gap between xerography-based technology and conventional lithography based printing technology. The current gap in xerography is that after a certain number of copies (~1000) are made, the charge on the photosensitive drum wears off. This means another refresh cycle is needed on the drum to make additional copies. On the other hand, conventional lithography based printing technology is expensive to use for short printing runs, although this problem has been addressed to using short run consumable media. However, the pre-imaging time that is required to image a new printing plate is considerable (~40 minutes to 1 hour) depending upon the plate imaging technology. The new semiconductor based printing technology in accordance with the printing system described herein could bridge this gap in such a manner that printing can be now done for either short or long runs using the same machine.

There are furthermore several advantages of the described system in view of prior art printing methods.

The described system provides nearly infinite read, write, and erase capability, thus eliminating the need for an intervening consumable medium such as a printing plate that transfers the image to the final medium, noting that each printing plate can carry only one image, and after a certain number of copies or impressions the printing plate has to be discarded and a new printing plate has to be loaded to be re-imaged, due to the degradation in the quality of the image associated with wear.

The system described herein further provides means to directly download an image from computer memory or a scanner to the printing engine in order to either print documents of monochrome or color thus becoming a peripheral computing device that can print on demand from a computer or a digital imaging source. This capability virtually changes a printer into a digital device for making multiple copies with high throughput competing with commercial printing such as lithography or flexography or gravure without the environmentally unfriendly chemicals to deal with arising from commercial printing operations.

The printing system described herein also provides means to retain a charge on the printing engine corresponding to an image, until reset in the computer memory. Thus the memory location can hold a charge until reset by a digital signal. Thus it does not suffer from charge loss such as would occur on photoconductor drum-based electrophotographic printing machines.

Additional features and advantages will be set forth in the description which follows, and in part will be apparent from the description, or may be learned by practice of the disclosed printing system. The objectives and other advantages of the printing system will be realized and attained by the structure particularly pointed out in the written description and claims hereof as well as the appended drawings.

BRIEF DESCRIPTION OF THE DRAWINGS

The accompanying drawings, which are included to provide a further understanding of the printing system and are incorporated in and constitute a part of this specification, illustrate embodiments of the system and together with the description serve to explain the principles of at least one embodiment of the invention.

FIGS. 1*a*–1*b* show an insulated conductive layer or medium in a flat configuration.

FIGS. 2*a*–2*b* show how the memory layer is superimposed on the insulated conductive layer.

FIG. 3 shows an enlarged view of a memory cell.

FIGS. 4*a*–4*b* show memory cells overlaid on the insulated conductive layer for a cylindrical configuration of the print engine.

FIGS. 9*a*–9*b* show an alternative embodiment of the present invention utilizing organic polymers to form memory.

FIG. 10 shows how an image can be mapped onto memory locations.

FIG. 13 shows an exemplary single ended storage cell.

FIG. 14 is a cross sectional view of a semiconductor layout showing how a micro-via may be used to connect the transistors of a memory element to the surface of the chip.

FIG. 15 shows how an array of chips can be connected to create a large array.

DETAILED DESCRIPTION

Figure 1C:
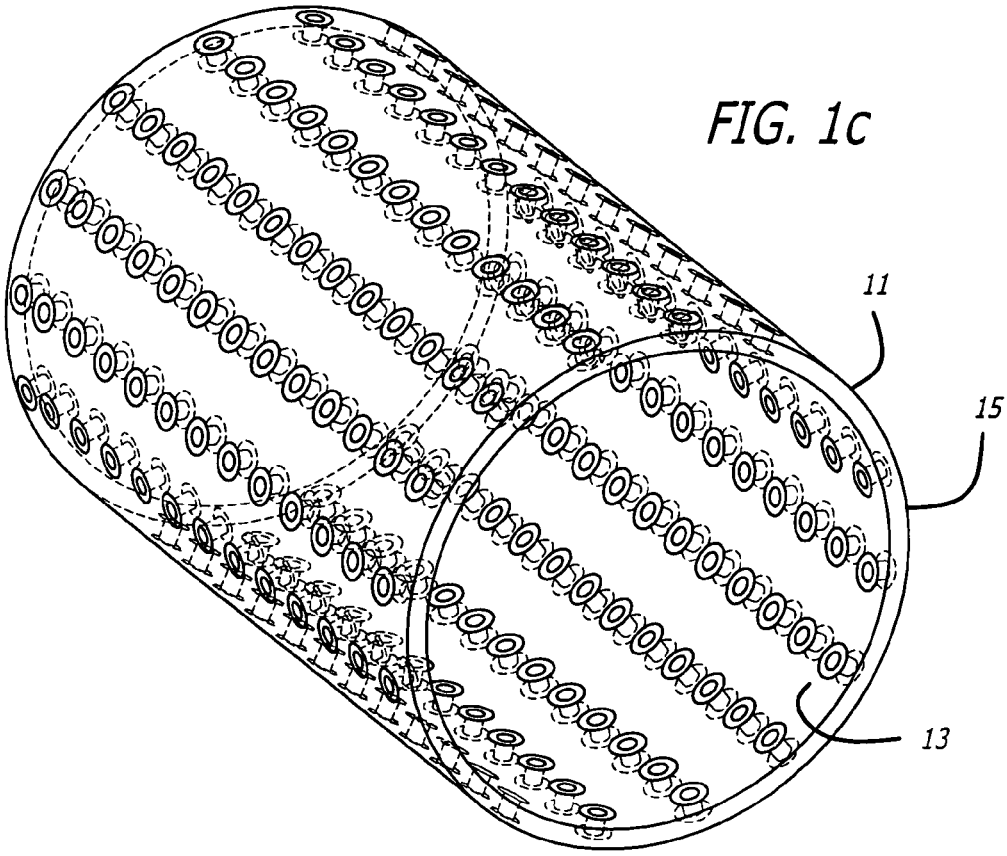
FIGS. 1*c*–1*d* show an insulated conductive layer or medium in a cylindrical configuration.

Reference will now be made in detail to the preferred embodiments of the printing system, examples of which are illustrated in the accompanying drawings.

An electronic stored image based scheme is proposed which permits the digital printing elements to print a digitally stored image onto any medium. This is accomplished by using a semiconductor memory-based scheme in which an image is stored in an electronic memory with each digital printing element occupying one memory location. Since information is stored in memory as a voltage, by directly coupling the memory location to a conductive element, the stored voltage can be used to directly control whether or not conductive toner based inks are attracted to that conductive element.

The system provides for a printing drum comprising a semiconductor memory. The semiconductor memory uses decoding elements to allow access to each of many storage locations without requiring an individual connection to each location. The system therefore utilizes the semiconductor memory structure to spatially map a digitally stored bit of data (e.g., 0 or 1) to a physical location.

In another embodiment, the semiconductor printing system can also be composed of a flat semiconductor memory panel, over which a system of charged and uncharged rollers can translate successively, and selectively transfer charged ink (toner) to and from the semiconductor memory panel to a printing medium.

As all printed images are generally composed of dots of ink at a specific location on a medium, it is possible to translate the specific location to where the ink can be transferred to a memory cell in a chip, and from the memory cell to the final printing medium. It is therefore possible to "load" an image efficiently over a bus or communication channel. Once the image is loaded into the memory, the conductive locations associated with each printing element receive the appropriate voltage and the image can be formed on any printing media. After a desired number of images have been printed, a new image can be downloaded and a new image can be printed. This is the basic principle of the print engine in accordance with the present invention.

The digital printing engine uses low voltage electrostatics to direct toners or other conductive printing inks to its surface. This print engine does not have any intervening consumable media such as a printing plate.

Print Engine Construction

The print engine of the disclosed embodiment comprises an insulated conductive layer and a semiconductor memory layer.

FIG. 1*a* shows an insulated conductive layer in a flat configuration. FIG. 1*b* is an enlarged view of the insulated conductive layer of FIG. 1*a*.

The insulated conductive layer comprises an insulating medium 11 having a top surface 10 and a bottom surface 12, a plurality of micro-vias 14 that connect the top and bottom surfaces of the insulator, conductive pads 16 on the top, and conductive pads 18 on the bottom surfaces of the insulator.

The insulating medium can be either flexible or rigid. Typical choices for the insulating medium include, but are not limited to: plastics such as nylon, delrin, ABS, ceramics or even metals such as aluminum or steel that can be cladded by a polymeric or ceramic insulating layer. The choice of the insulator depends on the application. The insulating medium has very small holes (approximately 20 microns in diameter) drilled through its thickness. The number of micro holes are determined by the dots per inch of printing tat is required from the specific printing application.

The micro-vias 14 are through holes filled with a conductor. These holes can be drilled using excimer lasers or by chemical means. As future technologies become available, other machining methods can be used to drill these through holes, or micro vias 14. The micro-vias 14 are filled with an appropriate conductor such as copper or silver or gold, or any appropriately solidifying conductive paste, and they terminate at both the top 10 and bottom 12 surfaces with contact pads 16 and 18.

The contact pads 16 and 18 can be circular or rectangular in shape. Thus the contact pads 16 and 18 help electrically connect the top and the bottom surface of the insulated conductor. The thickness of the insulating medium is determined by whether the insulator is used as a rigid medium or as a flexible medium. In some cases, the insulating conducting pad can be made flexible and can be superimposed on a rigid flat plate and thus have a higher flexural rigidity. Typical thickness of the insulated medium can range from a few thousand micro inches to a few inches. The insulated medium can be either flexible or rigid. Both flat and cylindrical geometries are possible in the flexible or rigid configuration. The type of application, namely flexible or rigid configuration, determines the thickness of the insulated conductive layer.

Figure 1D:
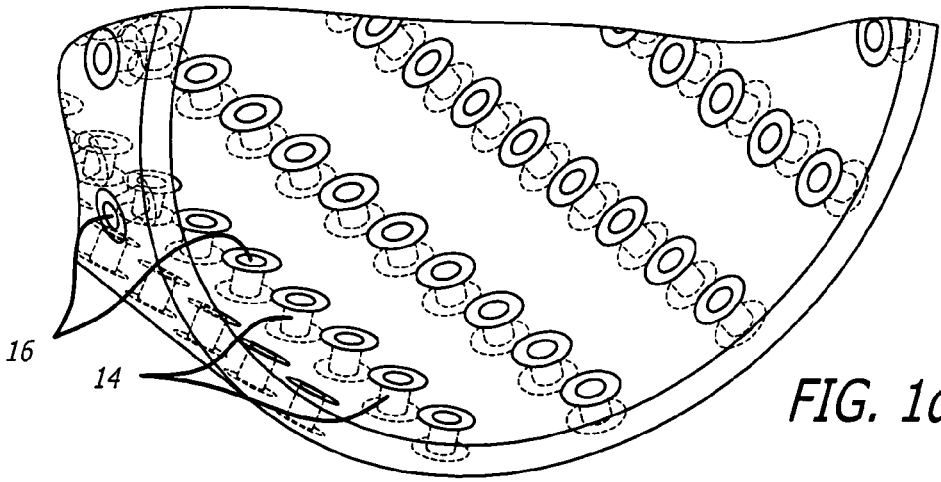

FIGS. 1*c*–1*d* illustrate an insulated conductive layer in a cylindrical configuration. The cylindrical configuration has an inner surface 13 and an outer surface 15, with micro-vias 14 and contact pads 16 and 18 at the end of each micro-via, at the inner 13 and outer 15 surface.

Semiconductor Memory Structure

The semiconductor memory layer contains the "brains" of the printing engine. Memory can be manufactured using several different technologies, such as conventional silicon based semiconductors, organic semiconductors that use organic materials for semi-conducting purposes, or magneto-electronic materials that can be fashioned into memory cells. The print engine construction based on conventional silicon based semiconductors and organic semiconductors are now described.

FIGS. 2*a*–2*b* illustrate a typical memory layer 20 as it is superimposed on the insulated conductive layer 22. The memory layer 20 is generally made up of an array of individual memory cells 24. Memory is made of transistors and can be directly patterned over the insulated conducting layer as shown in FIGS. 1*a* and 1*c*, using different techniques. Memory can be made using traditional silicon wafer based semiconductors or organic semiconductors which have recently been developed.

FIG. 3 shows an enlarged view of a memory cell. In FIG. 3, an asymmetrically conductive adhesive (also known as anisotropic conductive adhesive) is used to couple the memory cell layer to the conductive pads on the insulated conductive layer.

FIGS. 4*a*–4*b* show memory cells overlaid on the insulated conductive layer for a cylindrical configuration of the print engine. The inner contact pads are in conformal contact with the asymmetrically conductive adhesive and are not visible in this picture. FIG. 4*b* is an enlarged view of the cylindrical configuration of the print engine.

Figure 5:
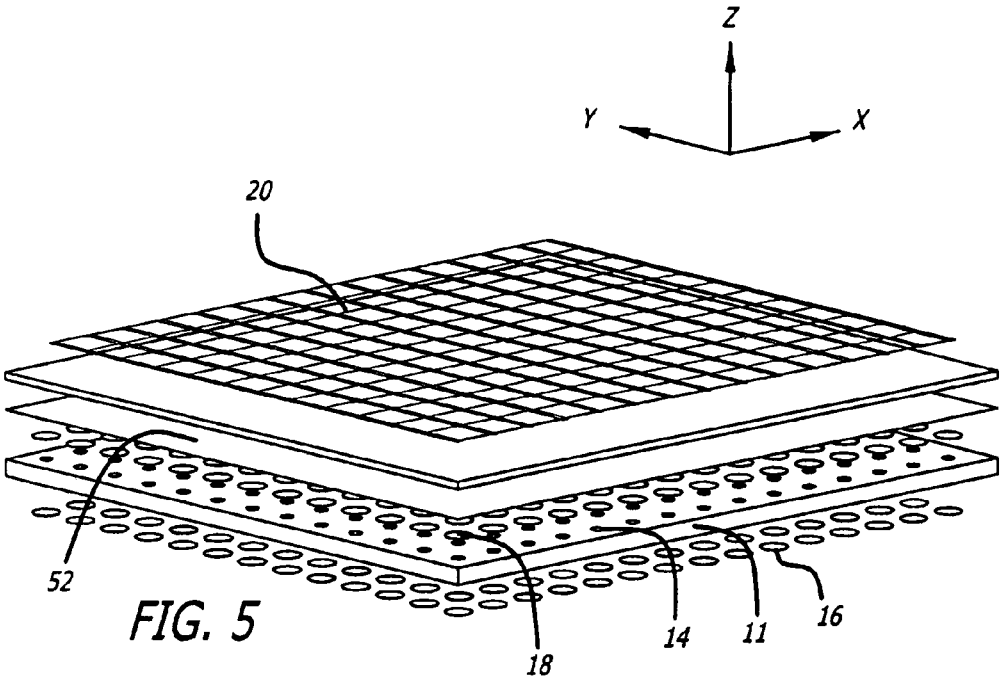
FIG. 5 shows an exploded view of how the different layers of the Print Engine are assembled.

FIG. 5 shows an exploded view of how the different layers of the Print Engine are assembled. The anisotropic conductive adhesive (ACA) binds the based memory layer to the insulated conductive layer, and using alignment marks during the assembly process, the individual memory cells are coupled to the contact pads on the insulated conductive layer, thus forming a single monolithic semiconductor based structure that can receive and store printing information.

Figure 6:
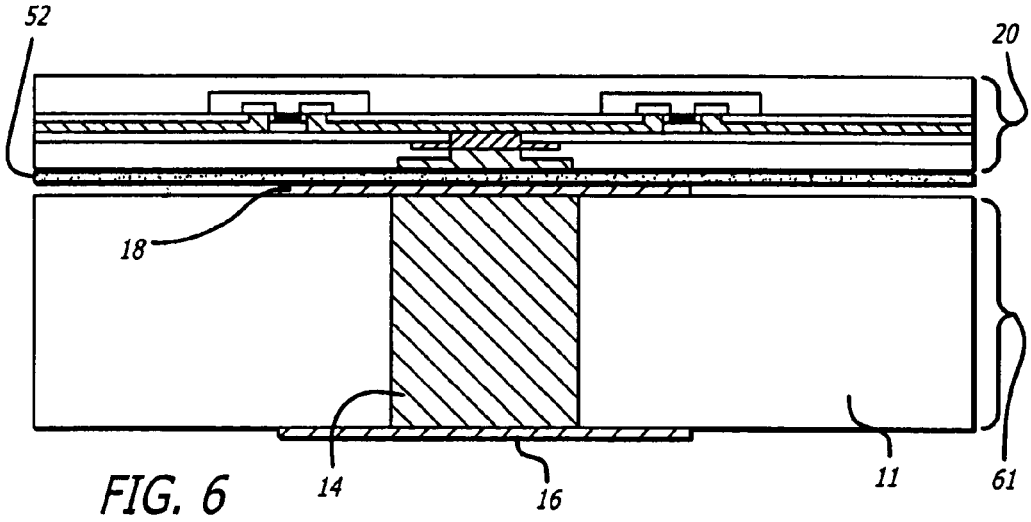
FIG. 6 shows the cross sectional view of a single memory cell coupled to a single conductive pad.

FIG. 6 shows the cross sectional view of a single memory cell coupled to a single conductive pad. The insulated conductive layer 61 is shown with micro-via 14 and top and bottom conductive pads 16 and 18. The insulated conductive layer is coupled to memory layer 20 using an asymmetrically conductive adhesive 52. FIGS. 2*a* through 6 show a flexible memory structure coupled to an insulated conductive layer with conductive pads.

Figure 7A:
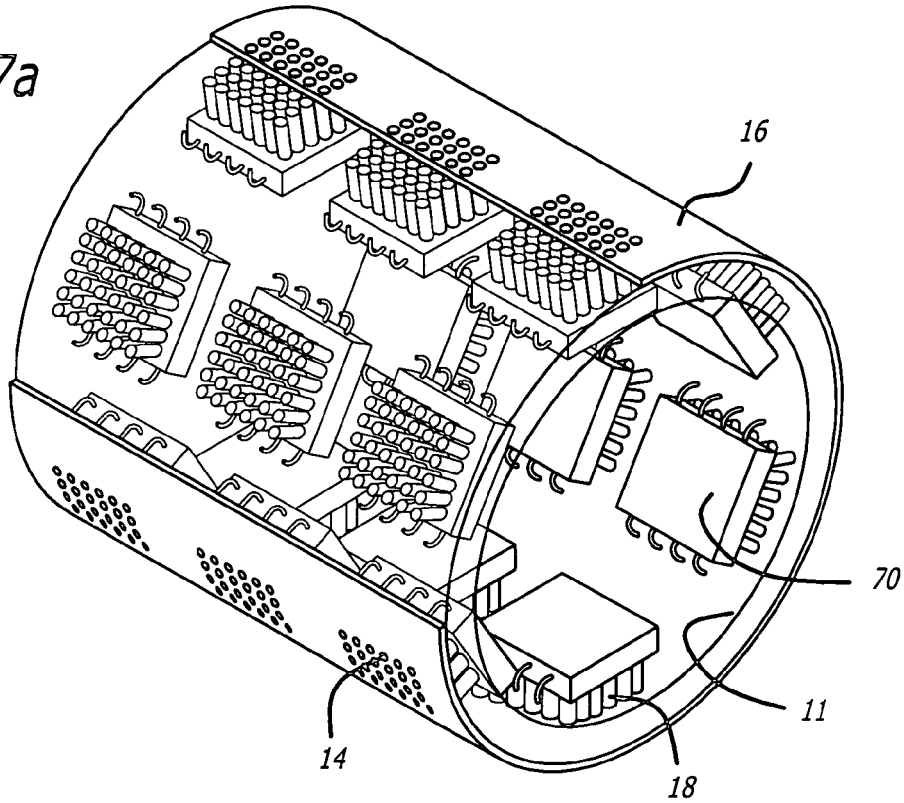
FIGS. 7*a*–7*b* show a cutaway and top views of an insulated conductive layer (and memory layer)/the print engine.

FIG. 7*a* shows a cutaway view of an insulated conductive layer containing micro-vias in a cylindrical configuration, coupled to packaged integrated memory chips. Part of the insulated conductive layer has been removed to show the asymmetrically conductive adhesive layer, and the location of the integrated memory chips. In this embodiment, the memory locations in the packaged integrated memory chips are directly coupled to the conductive pads on the cylinder using asymmetrically conductive adhesives.

Figure 7B:
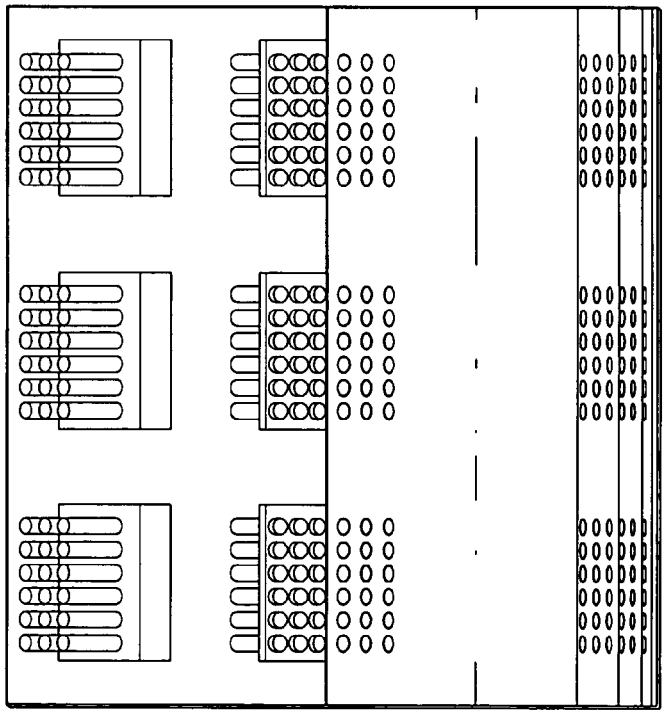

FIG. 7*b* illustrates the top view of an insulated conductive layer coupled to a packaged integrated memory chip. The dead space that exists between individual memory chips is also visible. These "dead spaces", do not contain any printing elements. By staggering the chip locations between two or more cylinders, it is possible to eliminate all dead space and evenly provide memory locations to print continuously in a linear fashion.

Figure 8A:
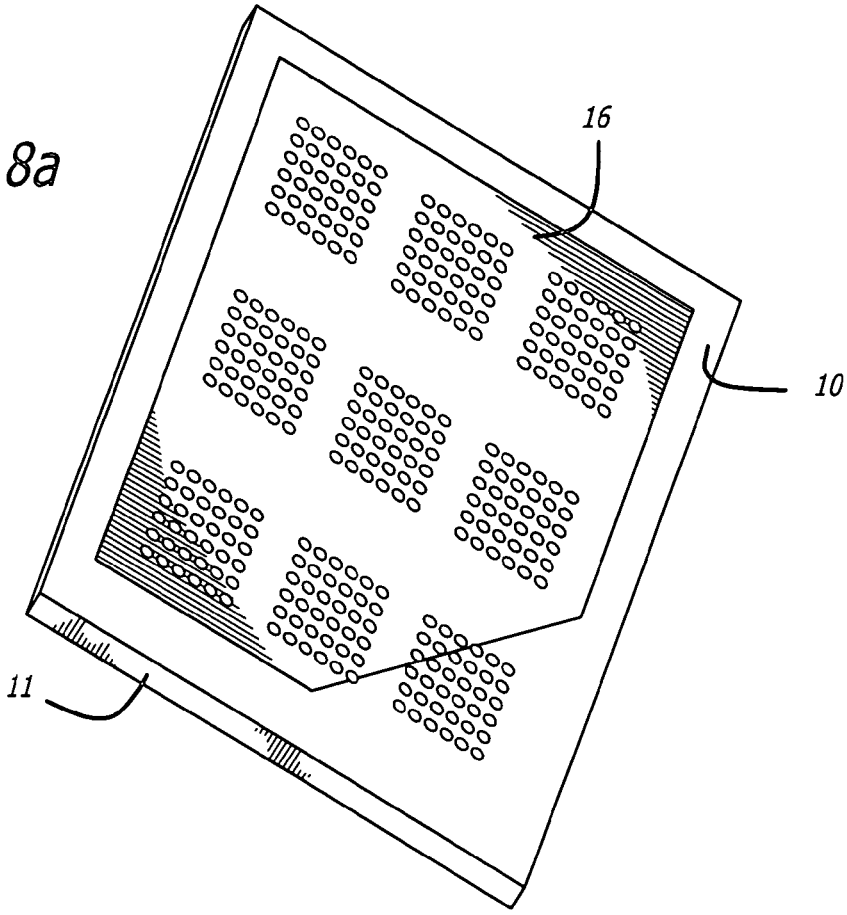
FIGS. 8*a*–8*b* show an insulated conductive layer in a flat geometric configuration.
Figure 8B:
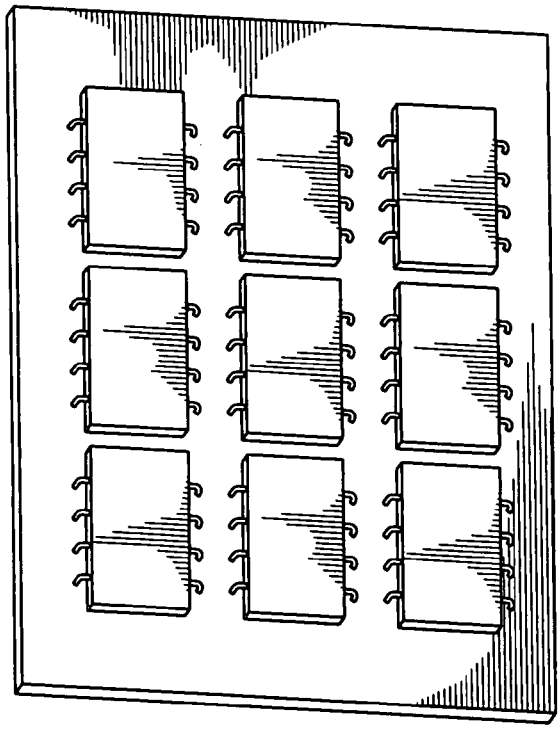

FIGS. 8*a*–8*b* show an insulated conductive layer in a flat geometric configuration. In FIG. 8*a*, the top surface is shown, and in FIG. 8*a* the bottom surface is shown. The integrated memory chip is attached to the bottom surface using different methods. One method is to use an asymmetrically conductive adhesive to bond the chip to the conductive micro-vias.

In FIGS. 1*a* through 6, the top surface generally represents the surface that will attract the ink. The bottom surface is generally where the memory chips or memory circuits are attached. The insulating layer isolates and provides mechanical isolation and electrical isolation between the chips and the ink receiving layers.

In both the packaged integrated memory chip and the flexible memory chip, the functionality of the memory elements is the same. The individual memory cells carry a voltage, and the voltage, when coupled to the conductive pads, is capable of attracting charged toner. What the memory circuits help avoid is the need to wire each conductive pad individually by an independent wire, which carries a voltage through it.

Using an asymmetrically conductive adhesive layer (ACA) is just one way to couple the insulated conductive layer to the memory cells. Other means can be used to couple the insulated conductive layer to the memory cells.

The memory structures identified in the preceding paragraphs, i.e. flexible and non-flexible, are some of the many possible configurations which spatially map an image stored in computer memory to a physical printing conductive point.

Is it also contemplated that digital printing elements using non-silicon based memory may be used. For example, in another embodiment of the present invention, a new method using organic semiconductor polymers to form memory is composed of a grid of intersecting electrodes which sandwich a polymeric layer can be used in the digital printing element construction. The intersection between the word (horizontal electrodes) and the bit lines (vertical electrodes) in these cases forms the point that connects to the physical printing conductive point. FIG. 9*a* shows one such potential structure, in a flat format. This is based on memory developed by Thinfilms, Inc. of Sweden. FIG. 9*b* shows an enlarged view of the structure described in FIG. 9*a*. This memory structure overlaid on the insulated conductive layer is also possible in a cylindrical configuration.

Details of Individual Memory Elements

Figure 11A:
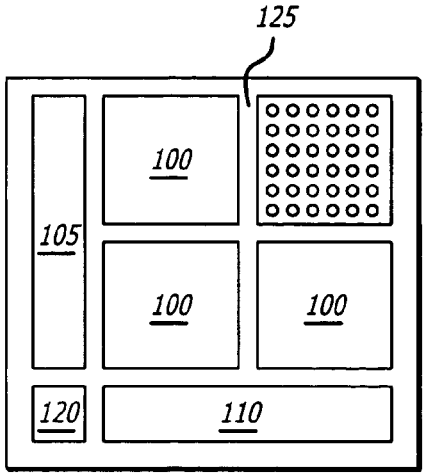
FIG. 11*a* is a block diagram of an exemplary semiconductor memory.

FIG. 11*a* is a block diagram of an exemplary semiconductor memory, which can be on a single integrated chip (IC). The address bus is used to access each memory location. Since the address is specified using a binary code, the number of connections to the chip needed to access many locations is $\log_2$ (n) where n is the number of memory locations. For example, for a standard 8'5" by 11" page at 300 dpi, which has 8,415,000 print locations, only 24 address bits are required to access all locations.

The integrated chip has row (105) and column (110) decoding circuits, along with global decoding and timing circuits (120). The storage locations are grouped in arrays (100), with channels (125) in between the arrays. The channels carry power, ground, and un-decoded or partially decoded address lines and other signals.

Figure 12A:
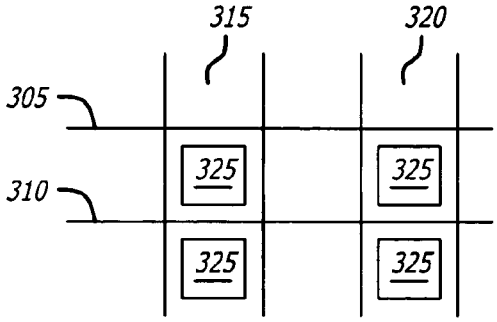
FIGS. 12*a*–12*b* illustrate various embodiments of how individual memory cells may be laid out.
Figure 12B:
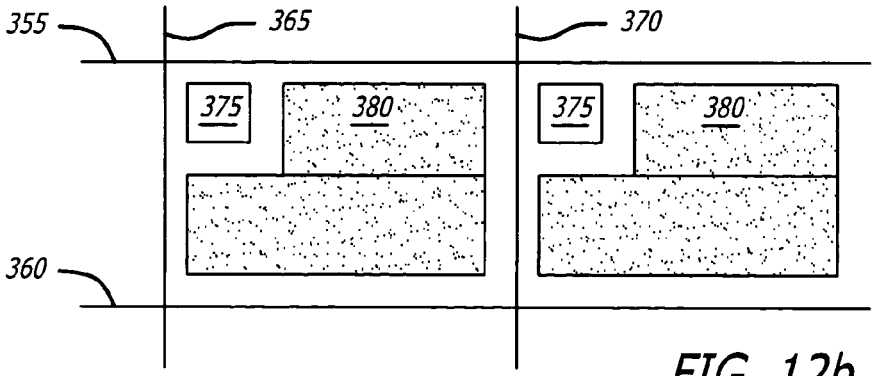

In a typical semiconductor memory, there is an array of storage elements 100 surrounded by peripheral circuitry. The array of storage elements, typically in the middle, is made up of areas of storage elements with areas in between which contain channels for power, ground and other signals. FIGS. 12*a* and 12*b* illustrate an exemplary single storage location in the memory.

Unlike a typical semiconductor memory, in which each element is designed to be as small as possible in order to increase density, these elements can be larger. This is because the pitch required for printing is much larger than the pitch achievable by semiconductor memories. A 300 dpi (dots per inch) image requires a dot pitch of approximately 85 micrometers (um), which is much larger than the pitch of storage elements or memory cells in a memory made in a modern semiconductor process. As a result, the pitch of the conductive elements at the surface is coarse, while the pitch at which the transistor elements, which form the memory in the semiconductor substrate, is fine. The transistor elements can therefore be larger, which makes them more robust and increases reliability and manufacturing yield. Furthermore the unused spacing can be used to perform local decoding which increases the uniformity of the memory array by moving some of the peripheral circuitry within the array itself, and also by making room for power, ground, and signal channels in between the elements.

Figure 11B:
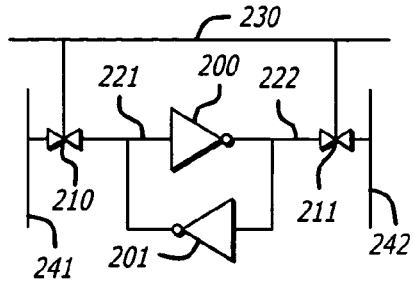
FIGS. 11*b*–11*c* show one storage location of the memory.

FIG. 11*b* is a storage element used in a semiconductor memory. This element is generally optimized to be as small as possible in order to maximize the storage density. FIG. 11*b* shows a diagram of a typical 6-transistor static memory (SRAM) cell. Inverters 200 and 201 are cross-coupled and connected to bit lines 241 and 241 via access gates 210 and 211. The nodes 221 and 222 at the outputs of the inverters are the charge storage nodes. The access gates are driven by the word line 230. In a typical semiconductor memory used for mass storage, the access gates 210 and 211 are usually single NMOS transistors.

In the digital printing element application, since area density is allowed to be less, the access gates 210 and 211 may be transmission gates rather than single NMOS transistors, which can improve noise immunity and cell robustness.

Figure 11C:
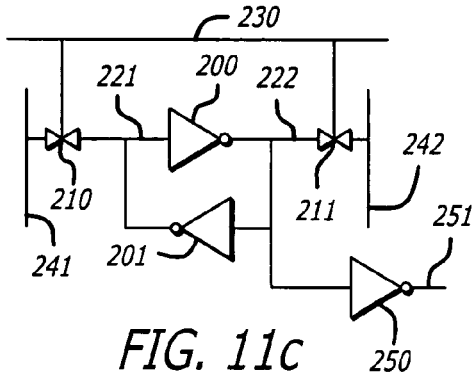

In FIG. 11*c*, the charge stored on a typical SRAM storage node (221 and 222) is small and so the node cannot be connected directly to the printing surface. In order to decouple the storage node from the printing surface, an additional inverter 250 is used to isolate the storage node 222 from the printing surface. The output 251 of the inverter 250 is coupled using the metal via to the printing surface.

FIGS. 12*a*–12*b* shows how the relaxed pitch can be used to make the array more uniform; FIG. 12*a* shows the layout of a conventional semiconductor memory. The array consists of a grid of word lines (305 and 310) and bit line pairs (315, 320). Memory cells 325 are placed at the intersections of the word lines and bit line pairs. Since the aim is to maximize storage by optimizing density, the cells are made as small as possible and packed as close to each other as possible. Therefore, the spacing between word lines 305 & 310 is minimized, as is the spacing between the bit line pairs 315 & 320, and these are generally just as much as is needed to fit the storage cell at the intersection. So, all decoding circuits which decode the incoming address to provide signals for the word and bit lines are placed at the periphery of the array, as shown in FIG. 11*a*.

FIG. 12*b* illustrates an embodiment whereby the decoding circuits are located with each memory cell, as opposed to outside of the array of memory cells. FIG. 12*b* shows how wires and decoding circuits can be interspersed with the storage elements of the array when the pitch is relaxed. Since the digital printing element does not have to be as densely packed as a semiconductor memory and does not have to operate as fast as a conventional memory, two modifications can be made. One, the cell (375) can be made single ended (i.e. it can use only one bit line (365, 370) instead of a pair of complementary bit lines), and two, the spacing between word lines (355, 360) and bit lines (365, 370) can be larger than in a conventional memory. Therefore additional decoding and buffering circuits 380 can be placed in the area available at the word and bit line intersections, in order to reduce the non-uniformity caused by having to place all the decoding circuits at the edges of the array.

One example of a single ended storage cell is shown in the circuit of a conventional master slave latch shown in FIG. 13. Many such circuits are known to those well versed in the art and can be used for this purpose.

FIG. 14 is a cross sectional view of a semiconductor layout and shows how a micro-via may be used to connect the transistors of a memory element to the surface of the chip to drive a print element. FIG. 14 shows the typical via structure used to connect the transistors to the printing surface. Transistors 410 and 420 are shown in a silicon wafer 415. The p-type transistor 420 is shown in an n-well 425, as is typical in CMOS technology. The transistor 420 has a source 431 and a drain 432 and a gate 433. The source 431 is connected via the metal contact and metal layer 441 as appropriate for the circuit (details not shown here).

The n-type transistor is constructed directly in the substrate 415 and has a source 411 and a drain 412 and a gate 413. The source 411 is connected as appropriate using a contact and metal layer 442. The two transistors are connected using contacts and metal layer 443. A dielectric layer 450 insulates metal layer 1 (441 and 442) from higher metal layers. A via and metal 2 layer 460 are used to connect down to metal layer 1 and the connection between transistors 410 and 420. Other connections (not shown) may also exist on this metal layer. There may be more metal layers (layer 3, layer 4) etc as required by the technology used to fabricate the circuit. Finally, a via 475 is used to connect the highest layer to the surface 480 of the chip. Dielectric layers 470, 465, etc are used to insulate the circuit at the lower levels from the surface. The topmost via 475 is finally connected to the printing surface using various means as discussed elsewhere in the document.

As is well known to those well versed in the art, this is a very typical configuration of transistors used to construct circuits in silicon. With reference to FIG. 11*c*, the transistors 410 and 420 together constitute the inverter 250, and the output 251 of the inverter is formed by the contact and metal layer 443 in FIG. 14. The other transistors used to form the memory cell are not shown, but their formation and connection is similar and can be understood by a person well versed in the art.

The yield of semiconductor chips reduces as their area increases. Therefore, it is not practical to make a single memory chip that covers the area of an entire page, but it is necessary to use many chips to cover an entire page or image area. FIG. 15 shows how an array of chips 500 can be connected to create a large array. In order to maintain a simple and efficient communication channel to the entire array, a communication bus scheme is proposed in which a bus 500/505 is used to connect all the chips 500. An arbitration and communication protocol will be used to allow each chip to be loaded with its portion of the image. Since image loading time is not a constraint in this application, it is possible to optimize the protocol for ease. of communication and low wire-count by using a low bandwidth protocol.

Busses 500 and 505 are used to connect the cells. These busses carry address, data, power, ground, and other signals, and are designed to reduce the wiring needed between the chips.

Figure 16:
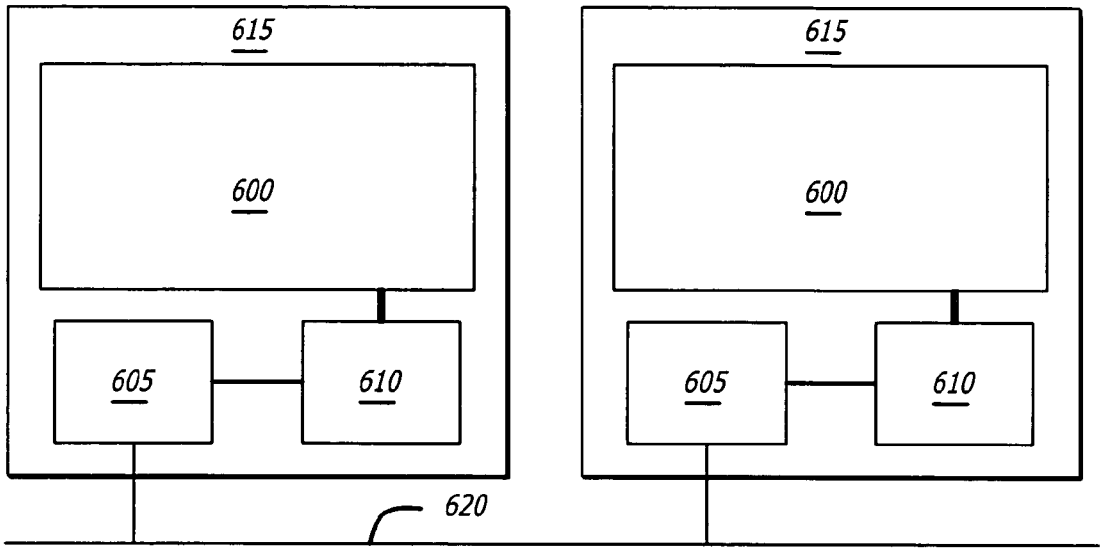
FIG. 16 is a block diagram of how each chip can be designed to have an interface element.

FIG. 16 is a block diagram of how each chip can be designed to have an interface element that handles the protocol, coupled with the image storage function described earlier.

The digital printing element array 600 is connected to conventional decoding circuits 610 that may be used in one chip. A communications controller 605 listens to the narrow bus 620 that connects the chips in an array. Communications controller 605 listens to the protocol on the bus 620 and recreates address and data information for the chip, which it passes to the decoding circuit 610 along a bus which is wider than 620. In turn, the decoding circuit 610 finishes the decoding and drives the array 600 along a bus of appropriate (as much as needed) width, as shown in the diagram.

Figure 17:
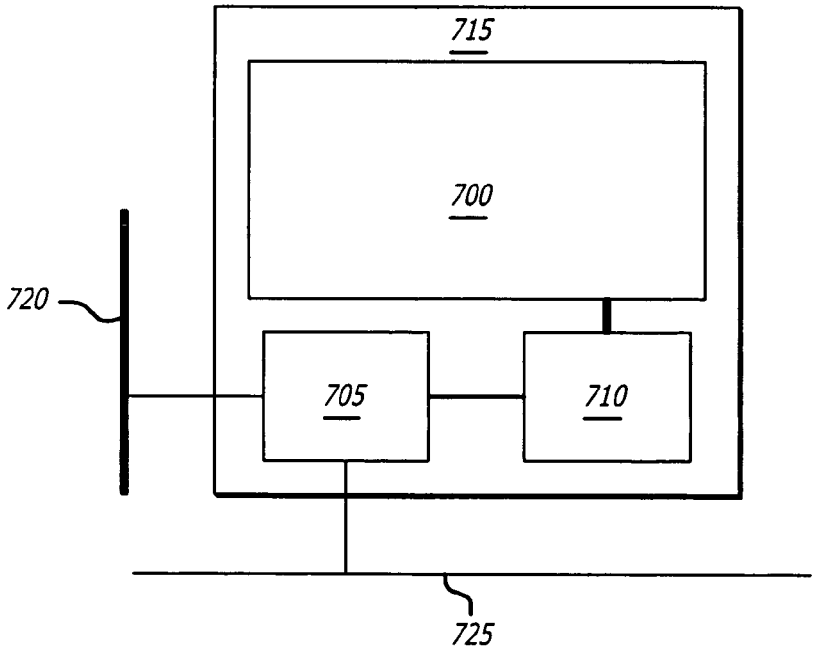
FIG. 17 illustrates an embodiment wherein each chip has a wireless link.

In order to reduce the number of wires and therefore increase ease and reliability, a low-bandwidth wireless link can be built into each array as shown in FIG. 17. Thus each array can be made into a sealed module with a unique address and only power and ground connections made externally. This can be used to control access to each module, and provide tracking and access control by including encryption and authentication in the communication protocol. In place of a wireless link, it is also possible to use some other physical connection that is made temporarily to download the image into the module, after which the connection is broken.

In addition to being a protocol engine as shown in FIG. 16, the block 705 can be a wireless communications processor, which uses an antenna 720 as its input bus for data, address, and other information. The antenna 720 can be built on to the chip 715, or can be an external metal trace that is connected to the chip. In this case, the bus 725 would only carry power and ground to the chips 715 in an array.

Working of the Print Engine

The print engine is composed of the semiconductor memory layer overlaid on the insulated conductive layer with a one to one correspondence of each memory cell with the conductive pad on the insulated layer. This combination of the memory cell with a conductive location is called a digital printing element. Once the overlaying of the memory cell with the conductive element is accomplished, then the entire structure can be fashioned into a either a planar structure or a cylindrical structure with the insulated conductive pads providing protection to the sensitive semiconductor memory from impact loading that occurs during the printing process.

As pointed out earlier, the memory storage array is not contiguous even within a chip. When an array of chips is put together, there will be spaces (dead space) between the image element arrays due to the peripheral circuitry on each chip as well as the edge space required on each chip in which active circuitry cannot be placed. Therefore we propose a scheme of using two consecutive elements, in two cylinders or two plates, in which the stored memory arrays are spatially overlapped such that the print locations of one cover the areas of the other in which print locations are absent. This will give continuous coverage of the printing surface by print locations. This scheme will also provide a built-in redundancy mechanism by which failed print locations on one cylinder or surface can be compensated by a corresponding location on the other surface. This scheme can be extended to more than two surfaces in order to improve coverage and reduce the impact of failed print locations on any one surface.

The image to be printed is first stored in a computer as a binary bit pattern, physically corresponding to a 1 or a 0 depending upon the presence or absence of a dot. From the computer, the memory can be directly downloaded to the memory location on a bit by bit basis, corresponding to the pixel value of the image stored. Thus there is a spatial map of the data corresponding to the image and the physical memory cell location. See FIG. 11*a* for a pictorial representation of the memory map. Thus each memory cell location will contain a digitally stored "1" or a "0" depending on whether the pixel in the original image is turned on or off.

Because the print image is stored electronically and there is an electronic map of how each image digital printing element maps on to a physical location, the print image can be aligned very easily by adjusting the specific locations in which individual image bits are stored. Physical alignment of the paper to the cylinder is not needed, and alignment can be done electronically by shifting or rotating the image, as it is stored in the print array. This problem overcomes alignment and registration of images and colors that are found in traditional lithography based printing presses.

By adding a scanner to the output of the printer, it is also possible to align the print elements. An image or images with a fixed pattern can be printed and then scanned. The scanned output can be examined either manually or using computer algorithms which can detect registration errors between the multiple print cylinders, and the images stored in the cylinders can be adjusted until the final image is free from registration errors. This process can be either fully automatic, or may be used to minimize the amount of human intervention required to align the images.

Figure 18A:
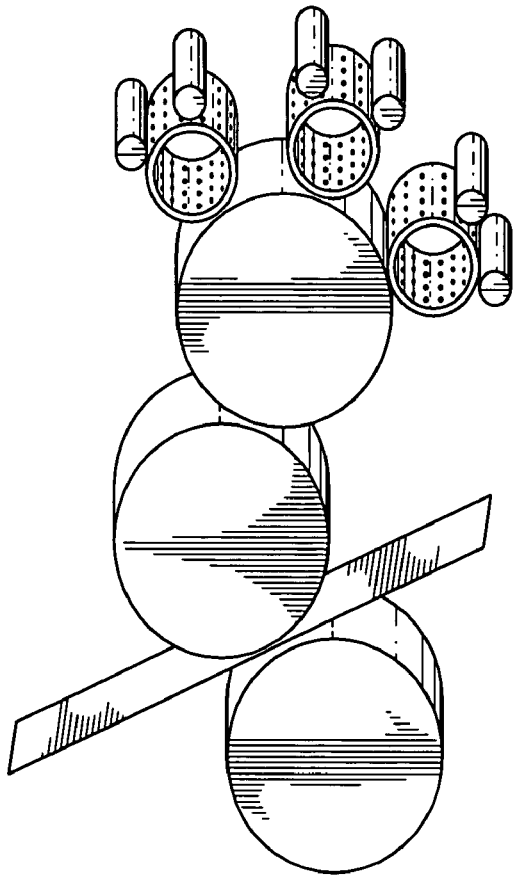
FIGS. 18*a*–18*b* illustrate an exemplary embodiment of a printing system.
Figure 18B:
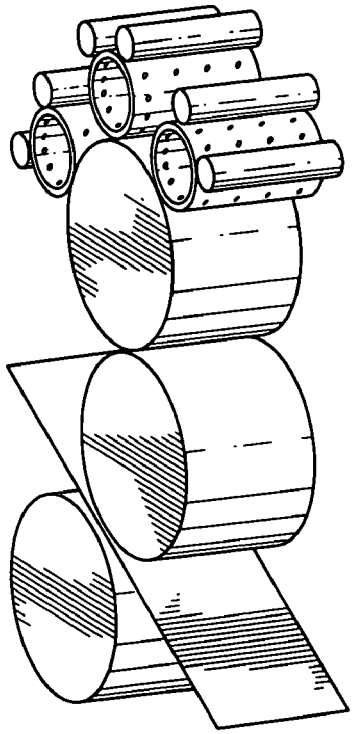

FIG. 18*a* shows how the print engine can be configured with an offset cylinder and inking cylinders to transfer charged ink from a source to the final medium (Paper or plastic or metal) in sheet or continuous web form. For sake of clarity, the electrical connections, and mechanical support structures have been omitted. The ink is transferred from the inking cylinders via electrostatic attraction to the print engine. The ink cylinder will carry a charge that is opposite to the charge carried by the locations on the print engine, which have a digitally stored charge on them. Thus the toner ink will have the same charge as the ink cylinder. This causes the ink to travel from the surface of the ink cylinder to the surface of the print engine, which has an opposite polarity of charge at the locations corresponding to the stored image. A multitude of print engines (3) are shown, as the image to be printed has to be spatialized without any dead space. From the print engine, the ink, which is only attracted to locations that have the pixels turned on the entire digitally stored image, is transferred to the offset cylinder. This offset image is transferred to the upper transport cylinder and from there it will be transferred finally to the printing medium. This process goes on continuously, until all the ink is depleted or the image is changed. FIG. 18*a* shows a perspective view from a different viewing angle with more details of the internal structure of the print engine. FIG. 18*b* shows another perspective viewing angle of the print engine and the associated components. In this perspective viewing angle the contact pads on the print engine are also visible.

In FIGS. 18*a*–18*b* the inking cylinders can all carry black ink, in which case the printer will be configured to print in monochrome. To print in color, four stations, each identical to the one configured in FIG. 18*a* can be arranged in series such that the medium such as paper or plastic or metal can successively pass through each station and acquire the component of color from each station. A subtractive color printing scheme employing cyan, magenta yellow and black colors could be used in each of the stations respectively to generate the composite color density required by the final image. A software based color separation scheme that will separate the color pixels from each image to be printed will be used to download the pixels into each of the print engines. In addition to the subtractive colors and black, additional colors can also be used for highlighting and other glossy effects. An extra print engine configuration in series with the four colors would be necessary in such a situation.

Figure 19A:
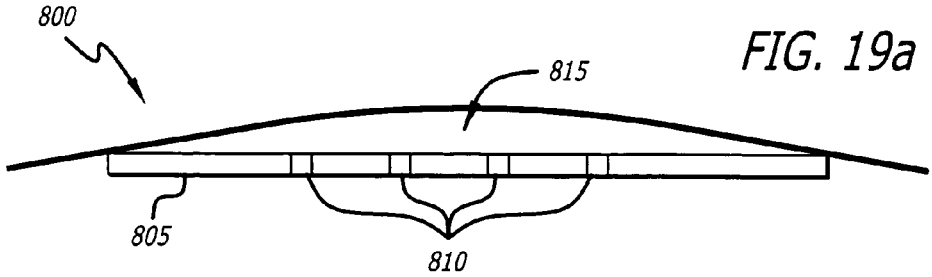
FIGS. 19*a*–19*b* illustrate methods of adapting a traditionally flat chip onto a curved printing surface.
Figure 19B:
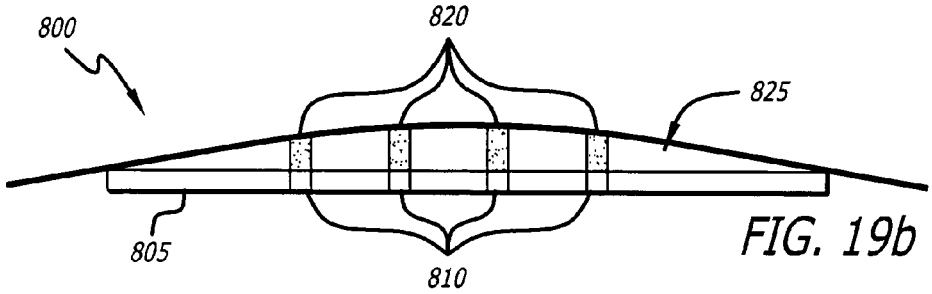

In FIG. 19*a*, some methods of adapting the flat integrated chip 805 to a curved printing surface 800 are shown. The chip has vias 810 that are connected to the storage elements and bring the stored voltage to the surface as discussed earlier. In FIG. 19*a*, a directionally conductive adhesive 815 is used to connect the vias at the chip surface to the curved printing surface. This adhesive serves as a vertical connection as well as a strain relief layer. FIG. 19*b* shows a grid of columns 820 which are used to connect the chip surface to the printing layer. These columns are typically made of metal, though other materials may be used. An insulating material 825 can be used to fill in the gaps between the columns, and this material also acts as a support and strain relief layer.

Figure 20:
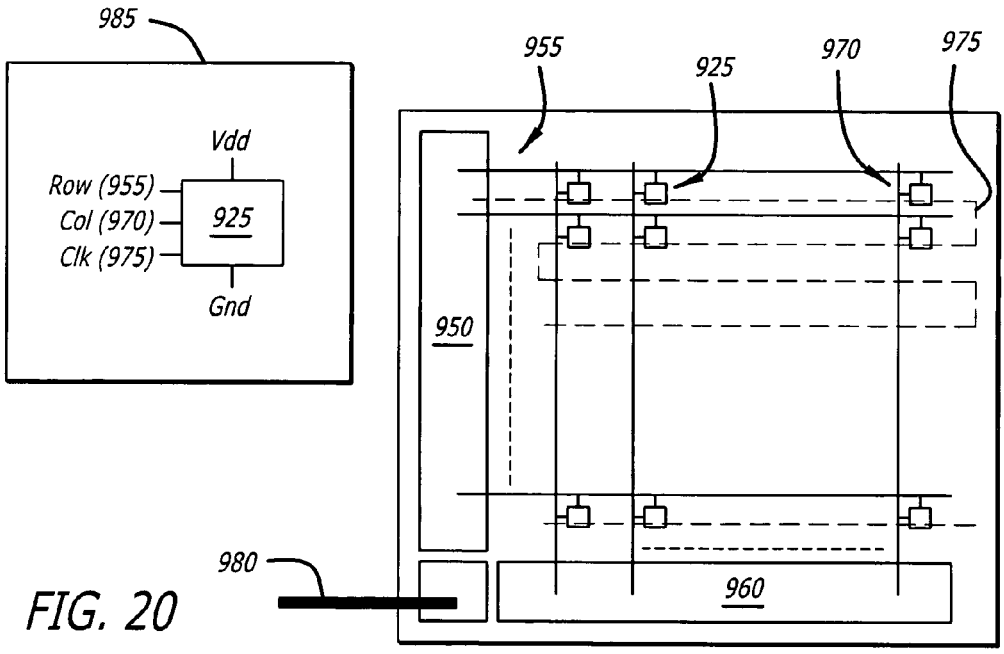
FIG. 20 shows how a single-ended, thin film print element can be used.

FIG. 20 shows how a single-ended, larger-area thin-film print element 925 can be used. The inset shows the element 925, which takes in decoded row and column signals, a clock signal, and Vdd and ground. The arrangement of these elements into an array is also shown, and is similar to the conventional memory layout. The grid consists of coarse row and column decoding circuits 950 and 960, which decode the incoming addresses into rows (955) and columns (970). In addition, a global clock connection 975 is sent to all the storage elements 925. The storage elements 925 are placed at the intersection of the decoded row and column lines, and additional decoding circuits may also be placed there as discussed earlier. The address and data information for the chip is brought in on a bus 980.

FIG. 13 shows the circuit of a conventional latch circuit, which is traditionally used in IC design. It consists of a transmission gate 905, an inverter 910, a clocked inverter 915, and these are connected to form a storage element. Such an element may be more easily created using thin-film-transistor technology, since it is more robust because it can be made using larger transistors.

Figure 21:
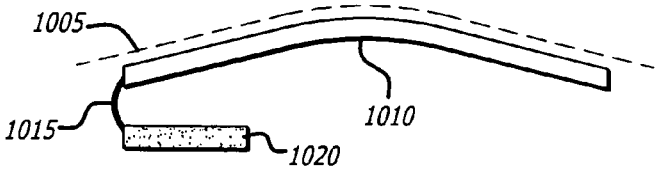
FIG. 21 shows the connection of a storage array to a thin film substrate.

FIG. 21 shows the connection of a storage array on a thin-film substrate 1010 to a conventional silicon chip 1020 using a flexible bus 1015. The flexible thin-film substrate can be made conformal to the printing surface 1005.

While the printing system has been described in detail and with reference to specific embodiments thereof, it will be apparent to those skilled in the art that various changes and modifications can be made therein without departing from the spirit and scope thereof. Thus, it is intended that the appended claims, and their equivalents, define the invention.

We claim:

1. A printing device comprising printing elements, each printing element comprising:

a conductive element which is coupled to a memory circuit via a buffer amplifier and mapped to at least one portion of a digital image, the conductive element being switchable between at least a first and second state, the first state being attracted to ink and the second state not.

2. The printing device of claim 1 wherein the conductive element is a conductive pad located at the end of a via.

3. The printing device of claim 1 wherein the memory is a semiconductor memory.

4. The printing device of claim 1 wherein a digital or an analog signal is used to drive the digital printing element.

5. The printing device of claim 1 wherein an array of printing elements are located on a cylindrical printing drum.

6. The printing device of claim 1 wherein an array of printing elements are located on a flat printing plate.

7. The printing device of claim 1 further comprising a insulated conductive layer, the insulated conductive layer comprising a insulated material having a plurality of conductive vias therethrough, each of the vias connected to the conductive element.

8. The printing device of claim 1 wherein individual printing elements are hard wired to at least one memory chip or alternatively to a multiplicity of memory chips.

9. The printing device as claimed in claim 1 wherein each printing element mayor may not be coupled to a memory location.

10. The printing device of claim 1 wherein the image to be printed is divided into a plurality of smaller portions and each portion is mapped to a printing element which is addressed by the memory.

11. The printing device of claim 1 wherein the memory is coupled to a flexible circuit directly such that the printing elements are directly attached to the individual memory cells on the chip.

12. The printing device of claim 1 wherein an individual memory cell in the memory is coupled to a flexible circuit, the flexible circuit having additional circuitry designed to enable the storage of a digital binary signal and the flexible circuitry having the capability to conform to a rectangular surface.

13. The printing device of claim 1 wherein the individual cells in the memory are coupled to a flexible circuit, the flexible circuit having additional circuitry designed on it to enable the storage of a digital or an analog binary signal, and the flexible circuitry having the capability to conform to a cylindrical surface.

14. The printing device of claim 1 wherein individual printing elements are hard wired to an integrated circuit chip or a multiplicity of chips using single or multilayer circuitry in such a manner as to provide a digital or an analog binary signal to the printing elements.

15. The printing device of claim 1 wherein individual printing elements are hard wired to a chip or a multiplicity of chips using single or multilayer circuitry and the printing elements are distributed on a flexible insulative medium.

16. The printing device of claim 1 wherein individual printing elements are hard wired to a chip or a multiplicity of chips using single or multilayer circuitry and have the printing elements distributed on a rigid insulative medium.

17. The printing device of claim 1 wherein digital data is transmitted to the cylindrical or planar memory configuration using wireless chip control circuitry along with the printing element driver integrated circuit chip.

18. A digital printing method comprising:

addressing charged ink or (toner) in a solid or liquid form to a location on a digitally driven data point or a printing element location using digital signals to drive the printing elements, wherein an array of chips are interconnected to each other and to a common bus, and are coupled to the underlying printing elements; and digitally decomposing an image (monochrome or color) and spatially mapping the image to the individual printing elements using integrated circuitry.

19. The digital printing method of claim 18 wherein a flexible circuit is used.

20. The digital printing method of claim 18 wherein an inflexible circuit is used.

21. The digital printing method of claim 18 wherein the printing elements attract or repel the charged ink or toner by electrostatic principles of charge attraction as a function of the digital signals provided by the semiconductor based memory devices without the use of LED arrays.

22. The printing method of claim 18 wherein the printing method is a non-lithographic technique of printing using electrostatic principles of charge attraction without the use of intervening printing medium such as printing plates.

23. The printing method of claim 18 wherein the image is printed using a charged ink such as a toner (solid or liquid) whereby the ink attracting location has a permanent charge in it sufficient to attract the charged ink until reset by a digital signal.

24. The printing method of claim 18 wherein color images are printed by a subtractive scheme wherein colored (Cyan, Magenta, Yellow and Black) ink is applied successively to media.

25. The printing method of claim 18 wherein color images are printed by an additive scheme by addressing colored (red, green, blue) inks to media.

26. The printing method of claim 18 wherein images are printed on media such as paper or plastics or wood based surfaces, and flexible or inflexible metallic media.

27. A method of digital printing, the method comprising the steps of:

providing a digital printing device, either planar or cylindrical in configuration, the printing device comprising an insulated conductive layer and a semiconductor memory, the insulated conductive layer comprising an insulated material having a plurality of holes(micro-vias) therethrough, each of the micro-vias filled with a conductive material, and each micro-via being terminated at each end with a conductive pad, and the semiconductor memory array comprising an array of individual memory cells, each of the memory cells capable of holding a charge and being superimposed onto the insulated conductive layer;

addressing each point of the semiconductor memory and mapping an image to the semiconductor array; and using a digital signal to assign an appropriate charge to each memory cell; and addressing charged ink in a solid or liquid form to the printing drum, thereby printing an image.

28. The method of claim 27 wherein a monochrome (black and white) or (gray scale) digitally scanned image is directly loaded onto the memory locations in a binary state corresponding to either the presence or absence of charge respectively at the printing element location.

29. The method of claim 27 wherein a colored image is digitally decomposed into its original subtractive color components namely cyan, magenta, yellow and black and additional colors or shading are directly loaded into individual cylinders or planar memory locations in the case of a flat memory structure respectively for each color in a binary state corresponding to either the presence or absence of charge respectively at the printing element location.

30. The method of claim 27 wherein printing elements are distributed on an insulated medium such as plastics using semiconductor based integrated circuitry.

31. The method of claim 27 wherein printing elements are distributed on a rectangular insulated medium.

32. The method of claim 27 wherein ink is transferred from the printing element surface to an offset cylinder.

33. The method of claim 27 wherein the printing element driver chips are staggered on two boards opposing each other to provide continuous coverage to drive printing elements on a rectangular surface.

34. The method of claim 33 wherein an offset cylinder is coupled to the staggered printing element drivers to transfer the ink from the printing elements to the offset cylinder.

35. The method claim 27 wherein the printing elements are distributed on a cylindrical insulated medium.

36. The method of claim 27 wherein the printing elements are connected to a flexible circuitry to reduce wiring density.

37. The method claim 27 wherein the memory storage and connecting elements are distributed between the printing element driver chips and the flexible circuitry that holds the printing elements.

38. The method of claim 27 wherein the number of dots per inch of printed matter is regulated by varying the space in between the individual printing elements that are energized in such a manner that the number of printing elements per unit area can be selectively addressed to produce digital half-toning effects.

39. The method of claim 27 wherein the number of dots per inch of printed matter is regulated by varying the space in between the individual printing elements that are energized in such a manner that the number of printing elements per unit area can be selectively addressed to produce monochrome digital half-toning effects while printing with one color ink.

40. The method of claim 27 wherein the number of dots per inch of printed matter is regulated by varying the space in between the individual printing elements on discrete cylinders or on planar printing elements that are energized in such a manner that the number of printing elements per unit area can be selectively addressed to produce color digital half-toning in discrete cylinders or planar printing element effects while printing with color ink.

41. The method of claim 27 further comprising the step of coupling an automated scanner to the end of the print cycle for error correction and proof reading of the printed material.

42. The method of claim 41 wherein the automated scanner is coupled to the end of the printer for registration and alignment of the inks in the printed medium.

* * * * *